US005226589A

United States Patent [19]

Davis

[11] Patent Number: 5,226,589

[45] Date of Patent: Jul. 13, 1993

[54] SELF-CLOSING MAILBOX DEVICE

[76] Inventor: Clarence O. Davis, 1100 Tucker Rd., Perry, Ga. 31201

[21] Appl. No.: 821,743

[22] Filed: Jan. 15, 1992

[51] Int. Cl.[5] ..... B65D 91/00

[52] U.S. Cl. ..... 232/17

[58] Field of Search ..... 232/17, 35-38; 49/386, 387

[56] References Cited

U.S. PATENT DOCUMENTS

| | | | |
|---|---|---|---|
| 1,564,073 | 12/1925 | Johnson | 232/17 |
| 2,431,838 | 12/1947 | Staley | 232/17 |
| 3,106,335 | 10/1963 | Allan | 232/17 |
| 3,163,356 | 12/1964 | Joehnk | 232/17 |
| 4,114,801 | 9/1978 | Van Orden | 232/17 |
| 4,223,828 | 9/1980 | Whitley | 232/17 |
| 4,299,058 | 11/1981 | Spaulding | 49/386 |

*Primary Examiner*—Renee S. Luebke
*Assistant Examiner*—F. Saether

[57] ABSTRACT

A mailbox having an extension spring located inside the mailbox body between the door and body interior which allows the mailbox door to remain open when it is pivoted below the mailbox floor while at the same time automatically allowing the door to close when it is pivoted above the floor level.

1 Claim, 1 Drawing Sheet

SELF-CLOSING MAILBOX DEVICE

SUMMARY OF THE INVENTION

There is a need for a mailbox on the market which uses an extension spring located inside the mailbox body that allows the mailbox door to remain open unassisted when it is pivoted below the mailbox floor and at the same time to automatically close the door when it is pivoted above floor level.

This kind of mailbox is produced by attaching an extension spring (inside the mailbox body) at one end to the mailbox door and at the other end to the interior of the mailbox.

This kind of mailbox presents advantages to mailbox owners and mail carriers: A door that automatically remains open once it is pivoted below the level of the floor allows for easy insertion and picking up of mail; the same door that automatically closes one the door is pivoted above the floor level saves the mail carrier time and minimizes loss of or damage to mail from wind, water or other elements. The door that remains open unassisted but automatically closes when pivoted upward also prevents open mailbox doors, which can be hit by passing vehicles, particularly those of mail carriers and road-maintenance crews.

REFERENCE TO DRAWINGS

FIG. 1 is a perspective view of a mailbox in accordance with the invention.

A mailbox is shown in FIG. 1 having a hollow body 4 with an opening 6 for receiving mail and a door 2 for selectively covering the opening.

DETAILED DESCRIPTION

Figure 1:
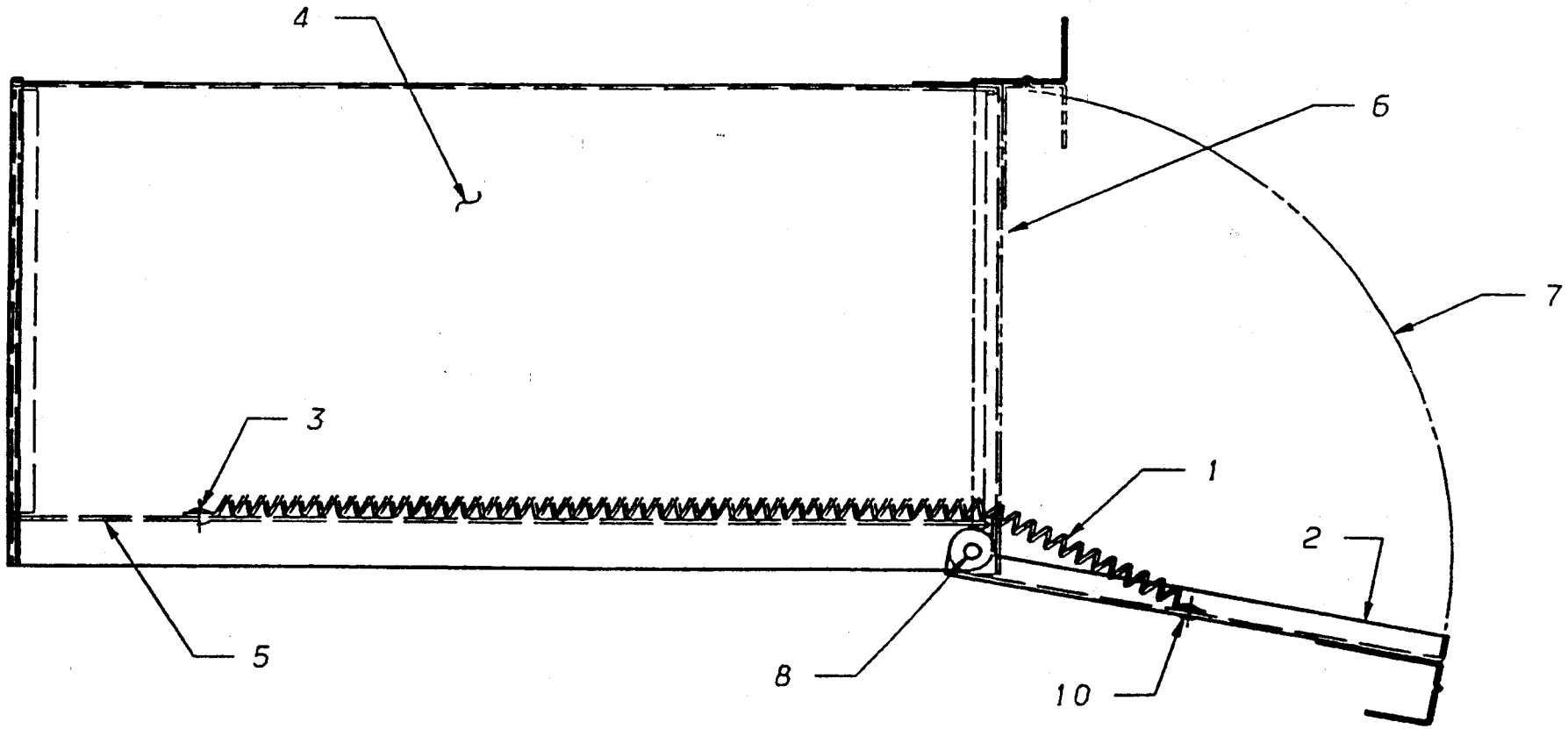

An extension spring 1 is attached to the mailbox door at one end 10 and to the interior of the mailbox body at the other end 3.

When the mailbox door is pivoted below a floor level 7, the spring breaks over the mailbox floor 5, causing the section of the spring extending from where it breaks over the floor 8 to where it is attached to the door 10 to exert less tension on the door 2, allowing the door 2 to remain open unassisted. When the door 2 is pivoted upward so that the spring 1 no longer breaks over the floor, the tension of the spring 1 causes the door to close automatically without further assistance.

The only spring included inside the mailbox in the cited patents is that of Allan, but it is attached to the rear door of the mailbox, not the front door; does not allow the mailbox door to remain open unassisted; and is there primarily for the purpose of keeping the rear door from being opened by mail that is placed by the carrier from the front end of the mailbox. Joehnk's spring located below the mailbox floor, Staley's spring provided on a pin, and Whitley's door biasing spring and door hinge pin are not located inside the mailbox body.

I claim:

1. A mailbox comprising a hollow body for receiving an extension spring, and a door providing an open position and a closed position wherein when said door is in the closed position the spring is completely enclosed inside said body and wherein the spring is attached at one end to a interior of the mailbox and at a other end to the door so that when the door is pivoted below a floor level the spring breaks over the floor, allowing the door to remain open unassisted, and so that when the door is pivoted upward and the spring no longer breaks over the floor and the door is spring closed.

* * * * *